US005340218A

United States Patent [19]

Cuthbertson

[11] Patent Number: 5,340,218

[45] Date of Patent: Aug. 23, 1994

[54] BULK STORAGE BAG WITH REMOTELY OPENABLE DISCHARGE SPOUT

[75] Inventor: Bruce Cuthbertson, Macon, Ga.

[73] Assignee: Transac, Inc., Macon, Ga.

[21] Appl. No.: 34,736

[22] Filed: Mar. 19, 1993

[51] Int. Cl.[5] ..... B65D 88/26

[52] U.S. Cl. ..... 383/67; 222/105; 222/185; 222/528; 220/402; 206/600

[58] Field of Search ..... 222/105, 185, 528; 383/87; 220/402; 206/600

[56] References Cited

U.S. PATENT DOCUMENTS

| | | |
|---|---|---|
| Re. 32,308 | 12/1986 | Nattrass . |
| 2,894,661 | 7/1959 | Simkins . |
| 3,374,929 | 3/1968 | Sifverskiold . |
| 3,789,897 | 2/1974 | Saito . |
| 3,827,471 | 7/1974 | Gregory . |
| 3,851,688 | 12/1974 | de Winter . |
| 3,961,655 | 6/1976 | Nattrass . |
| 4,113,146 | 8/1978 | Williamson . |
| 4,143,796 | 2/1979 | Williamson et al. . |
| 4,194,652 | 2/1980 | Williamson et al. . |
| 4,211,266 | 6/1980 | Massey . |
| 4,221,250 | 9/1980 | Manerba . |
| 4,222,422 | 9/1980 | Lofberg . |
| 4,235,366 | 11/1980 | Saito . |
| 4,284,229 | 8/1981 | Schmidt et al. . |
| 4,364,424 | 12/1982 | Nattrass . |
| 4,457,456 | 7/1984 | Derby et al. . |
| 4,518,106 | 5/1985 | LaFleur . |
| 4,573,204 | 2/1986 | Polett . |
| 4,691,371 | 9/1987 | Derby . |
| 4,759,473 | 7/1988 | Derby et al. . |
| 4,817,824 | 4/1989 | LaFleur et al. . |
| 4,863,065 | 9/1989 | Decrane . |
| 4,878,600 | 11/1989 | Derby . |
| 4,917,266 | 4/1990 | Kellenberger et al. . |
| 4,946,071 | 8/1990 | Poulton . |
| 4,946,291 | 8/1990 | Schnaars . |
| 4,953,987 | 9/1990 | Schnaars . |
| 4,966,311 | 10/1990 | Taylor . |

FOREIGN PATENT DOCUMENTS

| | | |
|---|---|---|
| 2-139383 | 5/1990 | Japan . |
| 2030958 | 8/1979 | United Kingdom . |

*Primary Examiner*—Joseph Man-Fu Moy

*Attorney, Agent, or Firm*—Bell, Seltzer, Park & Gibson

[57] ABSTRACT

The bag for friable material comprises a bottom surface panel for defining the bottom of the bag with respect to the vertical sides and the top portions of the bag when the bag is filled. The bag includes a discharge opening in the bottom surface panel which is defined by surrounding portions of the bottom surface panel. A foldable discharge spout is connected to the surrounding portions of the bottom surface panel for being maintained within the discharge opening when the beg is filled. A closure flap covers the discharge opening and the spout for being pulled open when the bag is filled. When the flap is pulled open, the spout unfolds under the weight of the contents and permits those contents to discharge. A pull strap is connected to the closure flap and has a length sufficient for portions to extend outwardly from one of the vertical sides of the bag. The bag includes means on the bottom surface panel and adjacent the one vertical side for supporting portions of the strap adjacent the vertical side when the bag is filled. As a result, when the strap is pulled outwardly from the vertical side, it in turn pulls the closure flap from the opening, thereby allowing the spout to unfold and the contents to discharge. This permits the bag to be opened from the side, rather than from underneath.

33 Claims, 6 Drawing Sheets

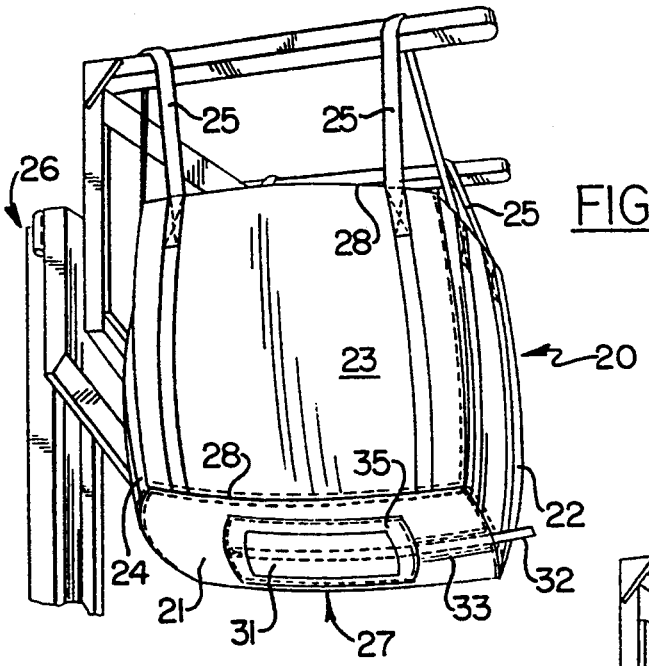
FIG. 1.
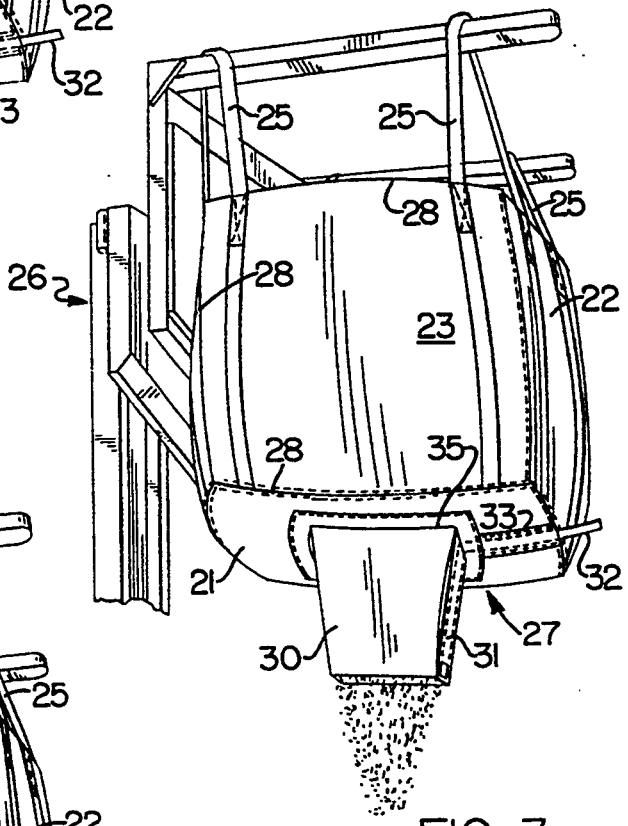
FIG. 3.
FIG. 2.
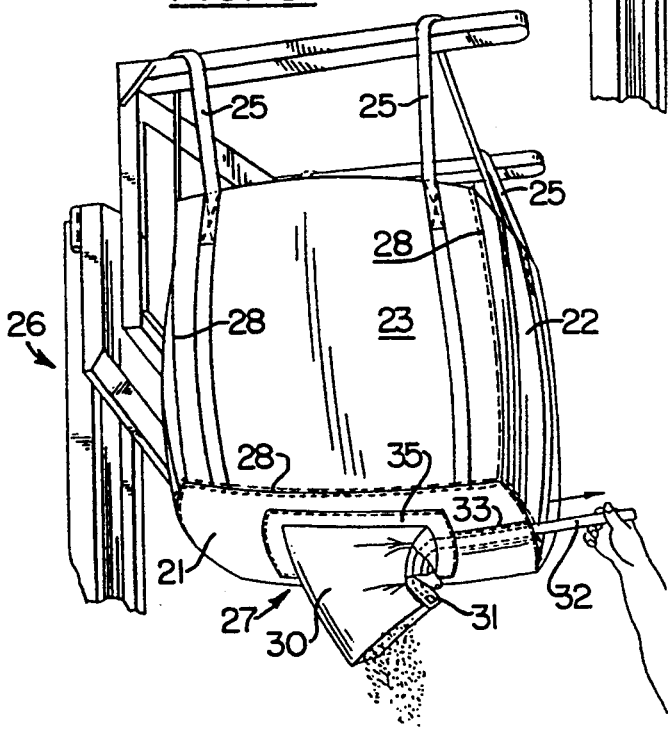

FIG. 8.
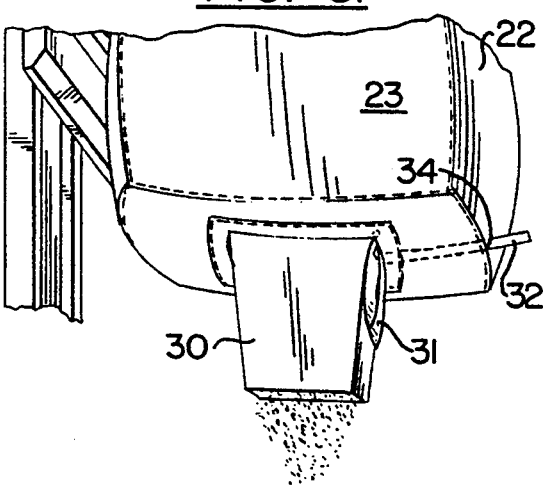
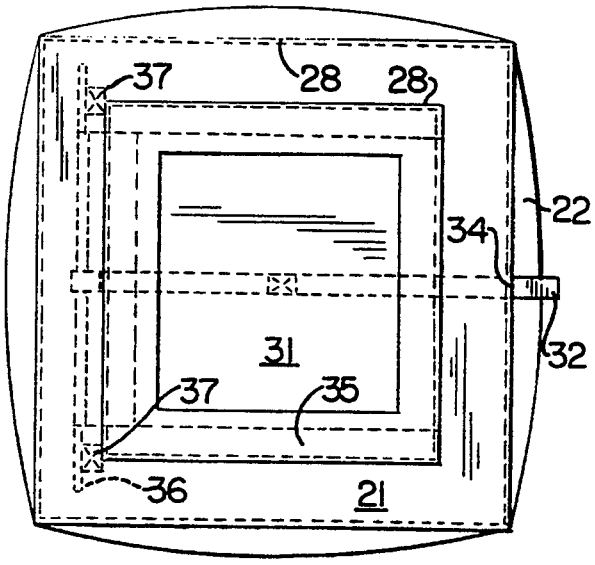
FIG. 9.
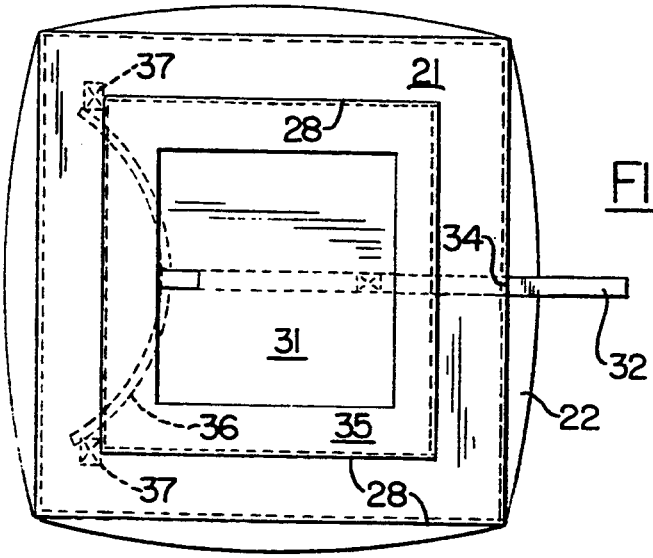
FIG. 10.
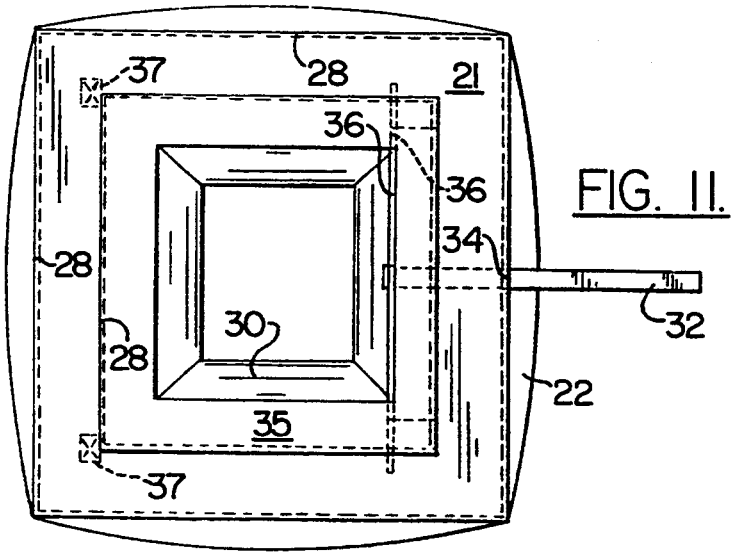
FIG. 11.

BULK STORAGE BAG WITH REMOTELY OPENABLE DISCHARGE SPOUT

FIELD OF THE INVENTION

The present invention relates to bulk storage bags and in particular relates to such a bulk storage bag with a remotely openable discharge spout.

BACKGROUND OF THE INVENTION

The present invention relates to flexible, collapsible receptacles known in the trade as "bulk storage bags." Typically, a bulk storage bag is used once as a disposable container for flowable or friable materials in bulk quantities and is then discarded, but the number of times such a container may be used or reused is unrelated to the present invention.

Typically, such bags are made of fabric such as a coarse weave of polyester, polyethylene, polypropylene, or other material of appropriate strength depending upon the size of the bag and the weight of the expected volume of contents. Bulk bags usually include some sort of handle or rings at their top portions so that the bag can be lifted by appropriate mechanical means such as a forklift or some other similar device.

In most circumstances, such bags also include an opening in their bottom portions from which the bag can be emptied. Such openings are covered and secured in a closed position when the bag is filled and transported. In order to open the bag and distribute its contents, the bag is usually lifted, and then the opening in the bottom portion is released or other-wise unsecured allowing the force of gravity to drain the bag's contents through the bottom opening. In some cases, a funnel, spout, or other shaped flexible portion is arranged to depend from the opening when the bag is opened.

A common disadvantage of such bags is that the bottom opening is usually located in the center of the bag's bottom panel. Typical bags form a solid rectangle (which can include a cubic shape) or a cylinder when filled. Because the bags are generally rather large in size; e.g. the bottom having dimensions of three or four feet in both length and width and a similar or greater height; the bottom opening is generally positioned approximately one-and-a-half or two feet inwardly from the vertical side edge of the bag. Thus, in order to open and empty such a bag, an operator must typically reach underneath the bag and unsecure its closure mechanism.

Given the large content volume of typical bulk bags, the task of manually reaching underneath such a bag and unsecuring the opening is often inconvenient, and potentially dangerous. At the same time, the closure over the opening must be secure enough to maintain the contents of the bulk bag in place during filling, handling, transport, and unloading operations. Accordingly, such well-secured openings that must be manually unsecured from underneath the center of a filled bag represents a significant problem in the use of such bulk storage bags.

Accordingly, there exists a need for such bags which can be maintained in a closed position during filling, transport, and other handling, but which can be more easily and more safely opened by an operator than can the presently available bags.

SUMMARY OF THE INVENTION

The invention is a discharge spout assembly for a generally flexible bulk storage bag having a discharge opening in the bottom surface thereof, and wherein the bag is of the type commonly used to transport friable materials such as grains, sand, gravel, or the like. The discharge spout assembly comprises a foldable discharge spout connected to the portions of the bottom surface of the bag that define the discharge opening and a closure flap over the discharge opening and over the spout for being pulled open when a bag incorporating said discharge spout assembly is filled so that when the flap is pulled open, the spout will unfold under the weight of the contents of the bag and permit those contents to discharge. A pull strap is connected to the closure flap and the spout, with the pull strap having a length sufficient for portions of the strap to extend outwardly from the one vertical side of the bag. The assembly includes means for being positioned on the bottom surface of the bag and adjacent the vertical side of the bag for supporting portions of the strap adjacent the vertical side of the bag when the bag is filled, wherein when the strap is pulled outwardly from the vertical side of the bag, it in turn pulls said closure flap from the opening and the spout, thereby allowing the spout to unfold and the material in the bag to discharge to thereby permit the bag to be opened from the side, rather than from underneath, and without any special equipment, and to provide for both greater convenience and increased safety.

In another embodiment, the invention comprises a bottom surface panel assembly for being incorporated in a generally flexible bulk storage bag, which bottom surface panel assembly includes the discharge spout assembly of the invention.

In yet another embodiment, the invention comprises a bulk storage bag incorporating the bottom surface and the discharge opening and spout assembly of the present invention.

The foregoing and other objects, advantages, and features of the invention, and the manner in which the same are accomplished, will become more readily apparent upon consideration of the following detailed description of the invention taken in conjunction with the accompanying drawings, which illustrate preferred and exemplary embodiments, and wherein:

DESCRIPTION OF THE DRAWING

FIG. 1 is a perspective view of a filled, closed bulk storage bag according to the present invention;

FIG. 2 is another perspective view of the bag in the process of being opened;

FIG. 3 is a third perspective view of the bag according to the present invention in a fully opened condition;

FIG. 8 is a partial perspective view of an opened bag illustrating a second embodiment of the invention;

FIG. 9 is a bottom plan view of the bag illustrated in FIG. 8 in the closed position;

FIG. 10 is a view identical to FIG. 9 but showing the bag in the process of being opened;

FIG. 11 is a view identical to FIGS. 9 and 10 and showing the bag completely opened;

DETAILED DESCRIPTION OF THE INVENTION

Figure 4:
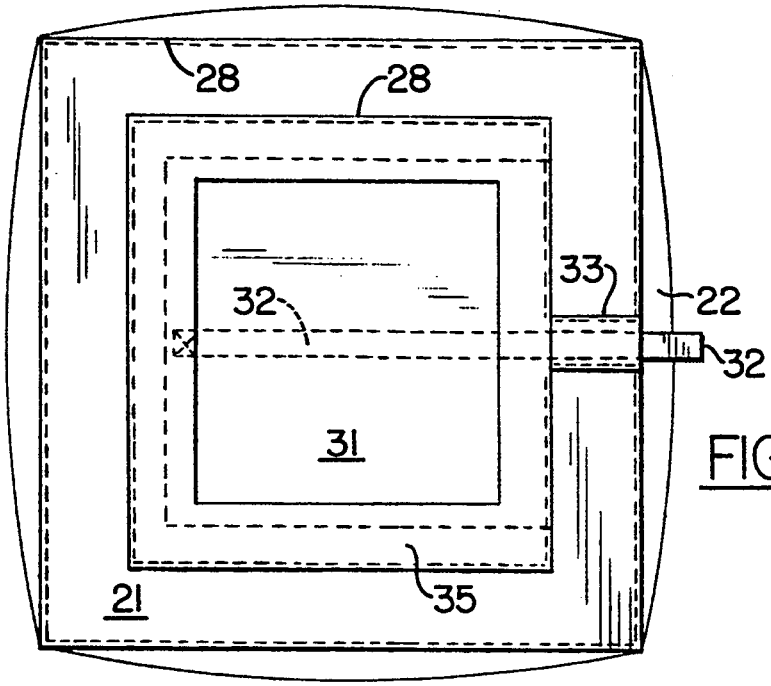
FIG. 4 is a bottom plan view of the bottom surface panel of a bag according to the present invention in the closed condition.
Figure 5:
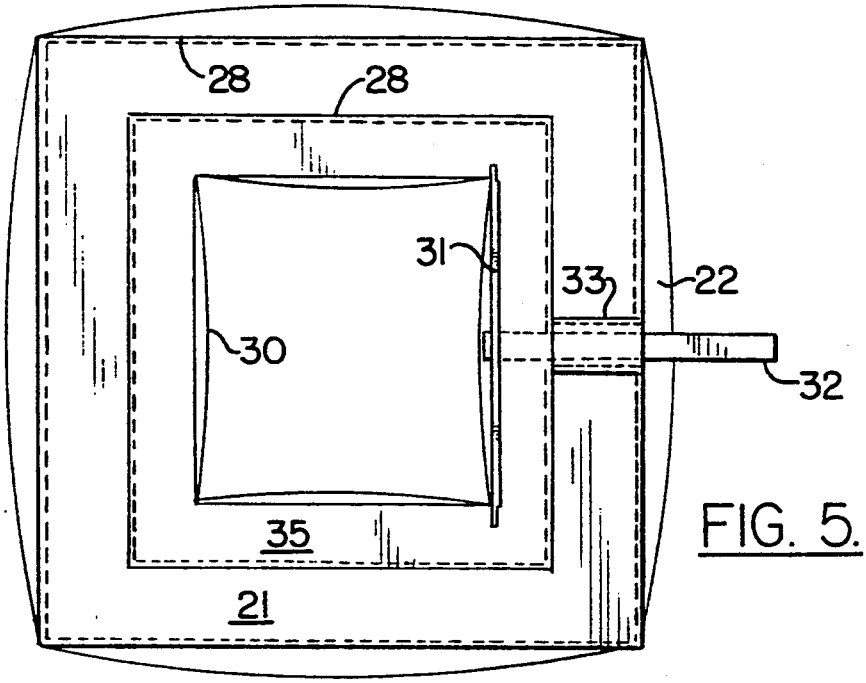
FIG. 5 is a view similar to FIG. 4, but showing the bag in the opened position.

The present invention is a generally flexible bulk storage bag of the type commonly used to transport flowable or friable materials such as grains, sand, gravel, or the like, and of which one embodiment is broadly designated at 20 in FIGS. 1, 2, and 3. As illustrated therein, the bag includes a bottom surface panel 21 for defining the bottom of the bag 20 with respect to the vertical sides and the top portions of the bag when the bag is filled. In the form illustrated in FIGS. 1–3, the bulk storage bag is a solid rectangle (rectangular polyhedron) when filled and compromises additional vertical side panels 22, 23, and 24. A fourth vertical side panel is not visible in the particular orientation of FIGS. 1–3. It will be recognized by those familiar with such bags, however, that they are occasionally formed in a cylindrical shape, but it will be quickly recognized from the description and claims herein that the invention can be reasonably incorporated into a variety of shapes of such bags.

In all of the drawings, the stitching typically used to form a bag from separate panels is designated at 28. It will be understood, however, that the invention is not necessarily limited to fabric bags formed from panels stitched to one another.

Typically, and as illustrated in the figures, such bulk storage bags include some means, here shown as the slings 25, for being lifted and carried by some mechanical device such as a forklift, portions of which are broadly designated at 26. The particular machinery used to lift the bag and the particular handles on the bags for receiving such equipment do not limit the present invention, are well understood in the art, and will not be described further herein.

The bag 20 includes a discharge opening broadly designated at 27. The discharge opening 27 is defined by the surrounding portions of the bag's bottom surface panel 21. A discharge spout 30 is connected to the surrounding portions of the bottom surface panel 21 and is normally positioned in a folded closed configuration within the discharge opening 21 when the bag 20 is filled, this arrangement being best illustrated in FIG. 1. As further illustrated in the drawings, the discharge opening 27 is most preferably positioned in center portions of the bottom surface panel.

A closure flap 31 is normally positioned in a closed position over the discharge opening 27 and the spout 30 when the bag is filled. The flap 31 is mounted for movement to an open position away from the discharge opening to allow the spout 30 to unfold under the weight of the contents of the bag 20, depend downwardly from the bag 20, and permit these contents to discharge.

A pull strap 32 has one end connected to the closure flap 31 and to the spout 30. A distal portion of the strap 32 is located outwardly away from the discharge opening In preferred embodiments, the pull strap 32 has a length sufficient for portions of the strap 32 to extend outwardly from the outside edge of the bottom panel 21 and from one of the vertical sides of the bag, again as best illustrated in FIGS. 1, 2, and 3.

The invention includes means, shown in FIGS. 1, 2, and 3 as the sleeve 33, on the bottom surface panel 21 of the bag 20 and adjacent the one vertical side 22 of the bag, for supporting and positioning portions of the strap 32 at a position on the bag from which the strap can be grasped and the bag opened from alongside, rather than underneath. Accordingly, and as can be seen from the sequence formed by FIGS. 1, 2, and 3, when the strap 32 is pulled outwardly from the vertical side 22 of the bag 20, the strap 32 in turn pulls the closure flap 31 from the opening 27 and from the spout 30. This allows the spout 30 to unfold and the material in the bag 20 to discharge. Perhaps most importantly, the invention permits the bag 20 to be opened from the side, rather than from underneath, and without any special equipment, and thereby provides for both greater convenience and increased safety.

In an alternative embodiment, the strap supporting means comprises a slot 34 (FIGS. 8–14) in the bottom surface panel 21 and adjacent the one vertical side 22. Portions of the strap 32 extend through the slot 34 and thus are positioned adjacent the one vertical side 22 of the bag 20. Again, by supporting the strap 32 adjacent the outside edge of the bottom panel 21 and the one vertical side 22 of the bag 20, the invention permits an operator to open the bag from the side, rather than from underneath.

In preferred embodiments, the bulk storage bag of the invention further comprises means for maintaining the flap 31 and the spout 30 closed under the weight of the bag's contents when the bag is filled. In the embodiment illustrated in FIGS. 1–7, the discharge opening 27 comprises a rectangle and the maintaining means comprises a rectangular frame of fabric 35 on the bottom surface panel 21 of the bag, and surrounding the discharge opening 27. The closure flap 31 has one peripheral edge secured to the bottom surface panel 21. The secured edge and the unsecured portions of the flap 31 and the spout 30 are tucked into the rectangular frame when the bag is filled, as best illustrated in FIG. 1, and are relatively straightforwardly disengaged therefrom by use of the strap 32 as previously explained and as illustrated in FIGS. 2 and 3.

FIGS. 8–11 illustrate a second embodiment of the flap and spout maintaining means. In those figures, the flap 31 further comprises a flexible rod 36 along the one edge of the flap 31 that is opposite the edge of the flap from which the strap 32 extends toward the one vertical side 22 of the bag.

In this embodiment, a pair of stops 37 are preferably sewn into the bottom surface panel 21 adjacent the opening 27 and keep the rod 36 in place and the flap 31 and the spout 30 closed when the bag 20 is filled. As illustrated in FIG. 10, the flexible rod 36 will bend when the strap 32 is pulled and disengaged from the stops 37 so that the flap 31 and the spout 30 will open and the contents of the filled bag can be discharged. In an alternative embodiment illustrated in FIGS. 12, 13, and 14, the flap and spout maintaining means comprises a pair of hook and loop fastener patches 40 on the flap 31 and a corresponding pair of hook and loop fastener patches 41 on the bottom surface panel of the bag.

Figure 12:
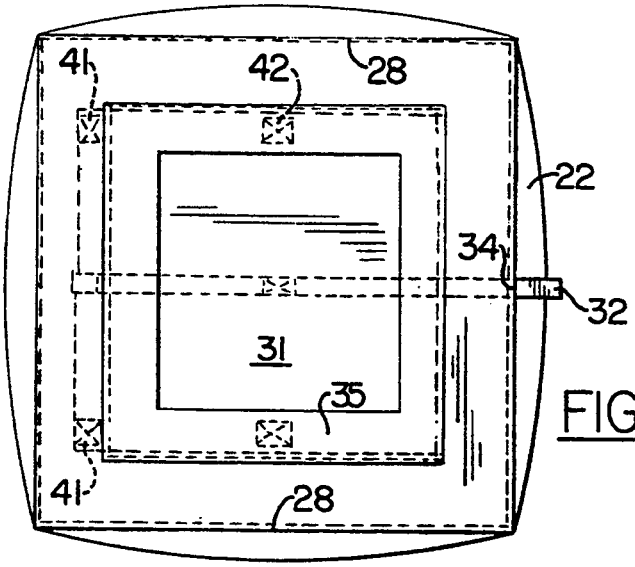
FIG. 12 is a bottom plan view of yet a third embodiment of the bag of the present invention illustrated in the closed position.
Figure 13:
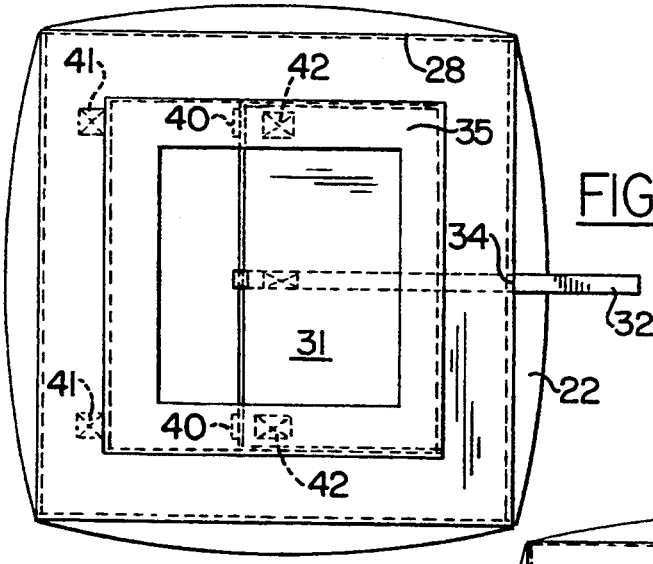
FIG. 13 is a view identical to FIG. 12 but with the bag in a partially opened condition.
Figure 14:
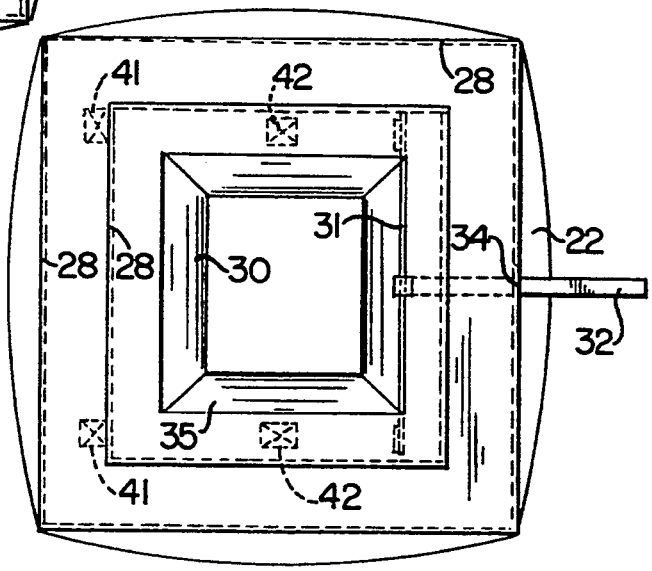
FIG. 14 is a view of the embodiment of FIGS. 12 and 13 illustrated in the fully opened condition.

In a most preferred embodiment, a second set of respective hook and loop fastener patches, which are most clearly illustrated at 42 in FIGS. 12, 13, and 14, can be incorporated into both the flap 31 and the bottom surface panel 21. As will be understood from FIGS. 8–14, the respective flap and spout maintaining means are most preferably positioned on the interior of the bottom surface panel 21 of the bag so that the weight of the contents in the bag provide an additional closing force, rather than a force that would encourage the bag to open.

Figure 6:
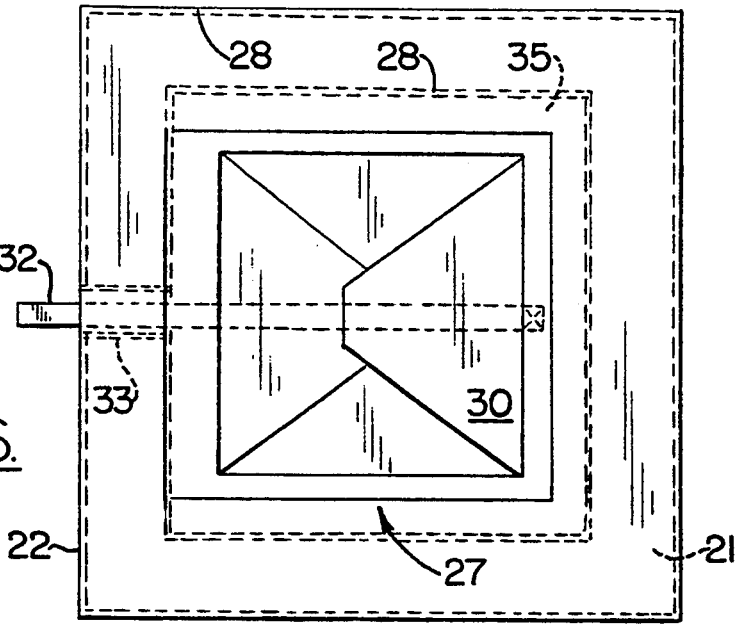
FIG. 6 is a top plan view of the bottom surface panel of the bag, i.e. as if seen from the interior of the bag, and shown in the closed condition.
Figure 7:
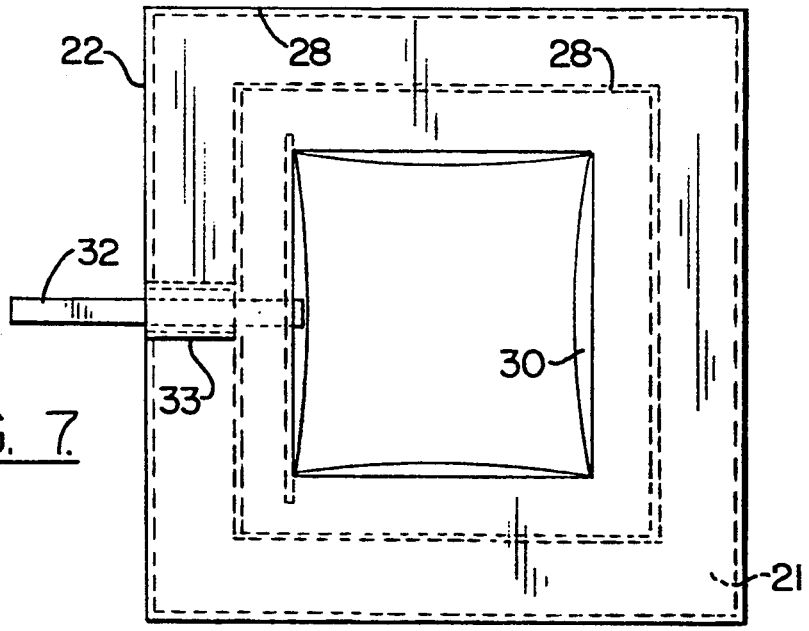
FIG. 7 is a view identical to FIG. 6, but showing the bag in the open condition.

A number of additional details are illustrated in the drawings. For example, FIG. 6 illustrates that in certain of the embodiments, the spout 30 is folded within the discharge opening 27. Furthermore, in FIGS. 1–7, the spout 30 is integral with the closure flap so that one side of the spout 30 serves as the flap 31. In other embodiments, such as those illustrated in FIGS. 8–14, the spout 30 and the flap 31 are separate pieces. In such cases, the spout 30 is preferably folded under the closure flap 31.

Figure 15:
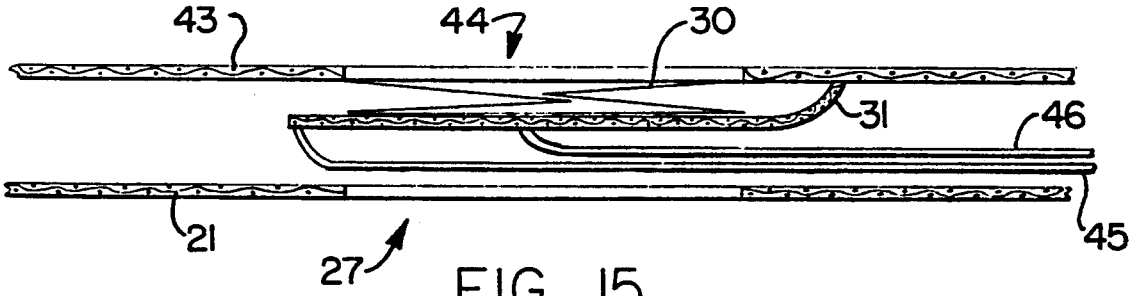
FIG. 15 is a cross sectional view of the bottom surface panel of one embodiment of the invention.

FIG. 15 illustrates a few further aspects of certain embodiments of the invention. FIG. 15 shows a bottom surface panel assembly that includes an additional liner panel 43 which overlies the bottom surface panel 21 on the interior face of the bottom panel 21. The liner panel 43 includes an opening broadly designated at 44 which is defined by surrounding portions of the liner panel 43 and which is coincident with the discharge opening 27. As illustrated in FIG. 15, in this embodiment, the spout 30 is connected to the surrounding portions of the liner panel 43 and the flap 31 is likewise connected to the liner panel 43.

FIG. 15 further illustrates that in one embodiment, the pull strap can comprise first and second portions 45 and 46. The first portion 45 is connected to the closure flap 31 at the edge of the flap 31 that is opposite the one vertical side of the bag from which the straps extend. The second portion 46 is connected to the center of the closure flap 31. As a result, pulling on the first portion initiates the opening of the flap 31 and the spout 30, and pulling on the second portion 46 completes the opening of the flap 31 and the spout 30 to thereby open the flap and the spout more easily and efficiently. The first and second portions 45 and 46 of the strap can be separate portions of the same piece that forms a loop, or as illustrated in FIG. 15, the first and second portions can comprise separate straps. Additionally, it will be understood that the pull straps 45 and 46, or the pull strap 32, can be formed of a fabric tape, a cord, a woven fabric, a knitted fabric, or any other appropriate material, the nature of the strap being such that these different materials can be incorporated as may be most efficient or convenient.

In another embodiment, the invention can be considered as a discharge spout assembly for a generally flexible bulk storage bag that has a discharge opening in the bottom surface thereof, while in a third embodiment the invention can be considered to be the bottom surface panel assembly for being incorporated in a flexible bulk storage bag. In either case, the discharge opening assembly or the bottom panel assembly can be incorporated into a variety of otherswise different bag structures.

In the drawings and specifications there have been disclosed typical preferred embodiments of the invention and, although specific terms have been employed, they have been used in a generic and descriptive sense only and not for purposes of limitation, the scope of the invention being set forth in the following claims That which is claimed is:

1. A flexible bulk storage bag useful for transporting flowable or friable materials, said bulk storage bag comprising:

a bottom surface panel and side panels;

a discharge opening in said bottom surface panel, said discharge opening being defined by surrounding portions of said bottom surface panel;

a discharge spout connected to said surrounding portions of said bottom surface panel, and normally positioned in a folded closed configuration;

a closure flap normally positioned in a closed position over said discharge opening and across said folded discharge spout, said closure flap being mounted for movement to an open position away from the discharge opening to allow said spout to unfold under the weight of the contents of the bag and permit those contents to discharge;

a pull strap having one end portion connected to said closure flap and having a distal end portion located outwardly away from said discharge opening; and means carried by the bag for supporting and positioning said distal end portion of said pull strap at a position remote from said discharge opening so that the strap can be grasped and the bag opened from alongside the bag rather than from underneath the bag.

2. A bulk storage bag according to claim 1 wherein said strap supporting means comprises a sleeve attached to and extending along said bottom surface panel of said bag from one edge of said discharge opening, with said pull strap being disposed within said sleeve, and with portions of the pull strap extending outwardly from said sleeve to permit grasping and pulling the pull strap when opening the bag.

3. A bulk storage bag according to claim 1 wherein said strap supporting means comprises a slot in said bottom surface panel adjacent one side thereof and through which portions of said strap extend.

4. A bulk storage bag according to claim 1 wherein said discharge opening is located at the center of said bottom surface panel.

5. A bulk storage bag according to claim 1 and including means cooperating with said closure flap for maintaining said flap and said spout closed under the weight of the bag's contents.

6. A bulk storage bag according to claim 5 wherein said means cooperating with said closure flap comprises a frame of fabric on said bottom surface panel surrounding said discharge opening, with peripheral portions of said closure flap being tucked between said bottom surface panel and said frame.

7. A bulk storage bag according to claim 6 wherein said discharge opening has a rectangular configuration, and said closure flap and said frame are also of a rectangular configuration, and wherein said closure flap has one peripheral edge thereof secured to said bottom surface panel, with the three other peripheral edges of the flap being tucked between said bottom panel and said frame but being removable therefrom when the closure flap is moved to the open position.

8. A bulk storage bag according to claim 7 wherein said pull strap is connected to said closure flap adjacent the peripheral edge of the closure flap which is opposite said one secured peripheral edge, and the strap extends across said closure flap and across said secured edge thereof to the side of the bag, so that upon pulling on the pull strap, the peripheral edge of the closure flap where said pull strap is connected is dislodged from said tucked relationship to thereby open the bag.

9. A bulk storage bag according to claim 8 further comprising a flexible rod located along said peripheral edge of said closure flap which is opposite said one secured edge, said rod having end portions projecting beyond the peripheral edges of the closure flap, and a pair of stops adjacent said opening in said bottom portion and engaging the projecting end portions of said rod for keeping said closure flap in place in the closed position, and wherein said flexible rod will bend when said strap is pulled to disengage from said stops so said closure flap will open and the contents of a filled bag can be discharged.

10. A bulk storage bag according to claim 5 wherein said means cooperating with the closure flap comprises cooperating pairs of hook and loop fastener material on said flap and on said bottom surface panel of said bag.

11. A bulk storage bag according to claim 1 wherein said bag forms a solid rectangle when filled.

12. A bulk storage bag according to claim 1 wherein said bag forms a solid cylinder when filled.

13. A bulk storage bag according to claim 1 wherein said spout is integral with said closure flap.

14. A bulk storage bag according to claim 8 including a second pull strap connected to the closure flap at a location adjacent the center of said closure flap, so that pulling on said first-mentioned pull strap initiates the opening of said flap and the spout, and pulling on said second pull strap facilitates completing the opening of said flap and spout.

15. A bulk storage bag according to claim 14 wherein said first and second pull straps are connected at their distal portions to form a loop.

16. A generally flexible bulk storage bag useful for transporting flowable or friable materials, said bulk storage bag comprising:

a bottom surface panel and side panels formed of a flexible woven fabric;

a discharge opening in the center of said bag bottom surface panel, said discharge opening being defined by surrounding portions of said bag bottom surface panel;

a discharge spout connected to said surrounding portions of said bottom surface panel, and normally positioned in a folded closed configuration;

a closure flap normally positioned in a closed position over said discharge opening and across said folded discharge spout, said closure flap being mounted for movement to an open position away from the discharge opening to allow said spout to unfold under the weight of the contents of the bag and permit those contents to discharge;

means for maintaining said flap and said spout closed under the weight of the bag's contents;

a pull strap having one end connected to said closure flap and having a distal end portion located outwardly away from said discharge opening; and means carried by the bag for supporting and positioning said distal portions of said strap at a position on the bottom surface panel adjacent one of the side panels, and from which the strap can be grasped and the bag opened from alongside the bag rather than from underneath.

17. A bottom surface panel assembly for a flexible bulk storage bag of the type useful for transporting flowable or friable materials, said bottom surface panel assembly comprising:

a bottom surface panel;

a discharge opening in said bottom surface panel, said discharge opening being defined by surrounding portions of said bottom surface panel;

a closure flap normally positioned in a closed position over said discharge opening, said closure flap being mounted for movement to an open position away from the discharge opening to permit the contents of the bag to discharge;

a pull strap having one end portion connected to said closure flap and having a distal end portion located outwardly away from said discharge opening; and means carried by said bottom surface panel for supporting and positioning said distal end portion of said strap at a position remote from said discharge opening so that the strap can be grasped and the bag opened from alongside the bag rather than from underneath the bag.

18. A bottom surface panel assembly according to claim 17 and further comprising a foldable discharge spout connected to said surrounding portions of said bottom surface panel, and for being normally maintained in a folded closed configuration within said discharge opening.

19. A bottom surface panel assembly according to claim 18 wherein said spout is folded under said closure flap.

20. A bottom surface panel assembly according to claim 18 wherein said spout is integral with said closure flap.

21. A bottom surface panel assembly according to claim 18 and further comprising:

a liner panel overlying said bottom surface panel on the interior face of the bottom panel;

an opening in said liner panel, said opening being defined by surrounding portions of said bottom surface panel and being coincident with said discharge opening;

and wherein:

said spout is connected to said liner panel opening; and said flap is connected to said liner panel; and said strap supporting means comprises a slot in said bottom panel adjacent the outside edge of said bottom panel.

22. A bottom surface panel assembly according to claim 17 wherein said strap supporting means comprises a sleeve for being attached to and for extending along said bottom surface panel from the edge of said discharge opening to the outside edge of said bottom panel, with said pull strap being disposed within said sleeve so that portions of said strap extend outwardly from the outside edge of said bottom panel.

23. A bottom surface panel assembly according to claim 17 wherein said strap supporting means comprises a slot in said bottom surface panel adjacent the outside edge of said bottom panel and through which portions of said strap extend.

24. A bottom surface panel assembly according to claim 17 wherein said discharge opening is located in the center of said bottom surface panel.

25. A bottom surface panel assembly according to claim 18 and including means cooperating with said closure flap for maintaining said flap and said spout closed under the weight of the bag's contents.

26. A bottom surface panel assembly according to claim 25 wherein said discharge opening is a rectangle and said maintaining means comprises a rectangular frame of fabric on said bottom surface panel of said bag and surrounding said discharge opening, with peripheral portions of said flap being tucked between said bottom surface panel and said rectangular frame.

27. A bottom surface panel assembly according to claim 25 further comprising a flexible rod located along the one edge of said flap opposite the edge from which said strap extends towards the outside edge of said bottom surface panel; and wherein said flap maintaining means comprises a pair of stops adjacent the opening in said bottom surface panel for keeping the rod in place and the flap closed when the bag is filled, and wherein said flexible rod will bend when said strap is pulled and disengage from said stops so the flap will open and the contents of a filled bag can be discharged.

28. A bottom surface panel assembly according to claim 25 wherein said flap maintaining means comprises a pair of hook and loop fastener means on said flap and a corresponding pair on said bottom surface panel.

29. A bottom surface panel assembly according to claim 17 wherein said panel comprises a rectangle.

30. A bottom surface panel assembly according to claim 17 wherein said panel comprises a circle.

31. A bottom surface panel assembly according to claim 17 and formed of a woven fabric.

32. A bottom surface panel assembly according to claim 18 including a second pull strap connected to said closure flap at a location adjacent the center of said closure flap, so that pulling on said first-mentioned pull strap initiates the opening of said flap and the spout, and pulling on said second pull strap facilitates completing the opening of said flap and spout.

33. A bottom surface panel assembly according to claim 32 wherein said first and second pull straps are connected at their distal portions to form a loop.

* * * * *

UNITED STATES PATENT AND TRADEMARK OFFICE

CERTIFICATE OF CORRECTION

PATENT NO. : 5,340,218

DATED : August 23, 1994

INVENTOR(S) : Cuthbertson

It is certified that error appears in the above-identified patent and that said Letters Patent is hereby corrected as shown below:

Title page, item [56],
UNDER "REFERENCES CITED":

Reference No. 3, "Sifverskiold" should be -- Silfverskiold --.

Reference No. 5, "7/1974" should be -- 8/1974 --.

Reference No. 5, "Gregory" should be -- Gregory et al. --.

Reference No. 8, "8/1978" should be -- 9/1978 --.

Reference No. 11, "6/1980" should be -- 7/1980 --.

Reference No. 14, "Saito" should be -- Achelpohletal --.

Title page, item [57],
IN THE ABSTRACT:

Column 2, line 9, "beg" should be -- bag --.

Column 1, line 32, "other-wise" should be -- otherwise --.

Column 4, line 1, after "ing" insert -- 27 --.

Column 5, line 9, "provide" should be -- provides --.

UNITED STATES PATENT AND TRADEMARK OFFICE

CERTIFICATE OF CORRECTION

PATENT NO. : 5,340,218
DATED : August 23, 1994
INVENTOR(S) : Cuthbertson

It is certified that error appears in the above-indentified patent and that said Letters Patent is hereby corrected as shown below:

Column 7, line 59, after "distal" delete -- end --.

Signed and Sealed this

Third Day of January, 1995

*Attest:*

*Attesting Officer*

Bruce Lehman

BRUCE LEHMAN

*Commissioner of Patents and Trademarks*